United States Patent [19]

Kirchner et al.

[11] 4,146,775

[45] Mar. 27, 1979

[54] AUTOMATIC CONTROL SYSTEM FOR AN ELECTRODE-TYPE AIR HUMIDIFIER

[75] Inventors: Robert T. Kirchner, St. Joseph County, Mich.; Vincent E. Bischoff, River Grove, Ill.

[73] Assignee: Armstrong Machine Works, Three Rivers, Mich.

[21] Appl. No.: 723,671

[22] Filed: Sep. 16, 1976

[51] Int. Cl.[2] ..... H05B 1/02; H05B 3/60; F24H 3/14

[52] U.S. Cl. ..... 219/295; 165/21; 219/272; 219/286; 219/289; 219/293; 219/497; 219/509; 236/44 R; 261/131

[58] Field of Search ..... 219/271–276, 219/284–295; 261/141, 142, 129, 131; 165/21; 236/44 R, 44 A

[56] References Cited

U.S. PATENT DOCUMENTS

| | | | |
|---|---|---|---|
| 2,152,157 | 3/1939 | Sittler et al. | 219/284 UX |
| 3,219,796 | 11/1965 | Graf et al. | 219/273 X |
| 3,584,193 | 6/1971 | Badertscher | 219/289 X |
| 3,761,679 | 9/1973 | Dall | 219/295 X |
| 3,780,261 | 12/1973 | Eaton-Williams | 219/295 UX |
| 3,937,920 | 2/1976 | Gundacker et al. | 219/295 X |
| 3,944,785 | 3/1976 | Eaton-Williams | 219/295 |

FOREIGN PATENT DOCUMENTS

| | | | |
|---|---|---|---|
| 1271282 | 6/1968 | Fed. Rep. of Germany | 219/286 |
| 2443136 | 3/1975 | Fed. Rep. of Germany | 219/295 |
| 2011638 | 6/1970 | France | 219/295 |
| 2186117 | 1/1974 | France | 219/295 |
| 2218530 | 9/1974 | France | 219/295 |
| 2279448 | 2/1976 | France | 219/295 |
| 1139911 | 1/1969 | United Kingdom | 219/295 |
| 1327215 | 8/1973 | United Kingdom | 219/295 |

*Primary Examiner*—A. Bartis

*Attorney, Agent, or Firm*—Blanchard, Flynn, Thiel, Boutell & Tanis

[57] ABSTRACT

An electric resistance humidifier which increases atmospheric humidity by boiling water in a tank. Spaced conductive plates, or electrodes, are fixed in the tank. As the tank water level rises, the immersed area of the electrodes increases. An electric supply causes the electrodes to pass electric current through the tank water therebetween for heating and vaporizing such water. Electric current and heating cease automatically when the tank water level falls below the electrodes. A control includes comparator circuitry responsive to a reference signal and a signal related to electrode current for actuating and deactuating a water supply to the tank. In one embodiment, the control includes further comparator circuitry responsive to electrode current and a further reference signal for controlling a tank drain, to compensate for rising conductivity of the tank water as it warms toward boil and thus prevent substantial overshoot in heating current flow. In one embodiment, humidity sensing circuitry varies the reference signal level, to increase the upper water level limit in the tank, and hence heating current flow and speed of vaporization, in response to decreasing atmospheric humidity, thereby to increase atmospheric humidity to a desired level. The aforementioned apparatus, if desired with a fan for distributing vapor boiled from the tank water, is housed in a cabinet. A manual adjustor for selecting a fixed reference or humidity level is conveniently located on a panel of the cabinet.

16 Claims, 10 Drawing Figures

AUTOMATIC CONTROL SYSTEM FOR AN ELECTRODE-TYPE AIR HUMIDIFIER

FIELD OF THE INVENTION

This invention relates to a humidifier, and more particularly to a specific method of controlling an electric resistance humidifier for heating water to generate steam.

BACKGROUND OF THE INVENTION

Humidifiers of various types are known. Some, which may be termed evaporative humidifiers, depend largely or entirely on relative movement between the air to be humidified and a water bearing surface. These include, for example, units wherein water is thrown from a high speed rotating wheel and rapidly enters the surrounding atmosphere as finely divided droplets, or wherein a moving airstream is directed past or through moving water bearing screens or porous members. Disadvantages of this general type of humidifier include the undesirable distribution of water droplets into the air, as well as mineral dust, bacteria and other contaminants from the water supply. Also, frequent cleaning maintenance is normally required, not only as to the evaporation unit itself but also as to environmental surfaces contacted by the thus humidified air.

Humidifiers of another type humidify by heating water sufficiently to generate steam, which is admitted to the atmosphere as the humidifying agent. Desirably, minerals in the supply water are not admitted to the humidified air, but rather remain in the heated water reservoir. Moreover, the boiling of the supply water to produce steam substantially kills bacteria and the like present in the water reservoir. Thus, a clean, sterile vapor is distributed to the environment.

It is known to generate steam by immersing electrodes in a supply of water present in an evaporating tank so that electrical current flows through the water between the electrodes and heats same to generate steam. The current amperage, and thus the amount of steam generated, depends on the electrical conductivity of the water and on the depth to which the electrodes are immersing in the water. In order to control the amount of steam that is generated, some of the water in the evaporating tank is drained to prevent buildup of the mineral salt content thereof, thereby to control the electrical conductivity of the water, and also the water level in the tank is controlled, thereby to control the current amperage. The electrical conductivity of tap water varies widely depending on the source thereof, e.g., city water mains, wells, etc. This introduces vexing problems of maintaining properly controlled water conductivity. Careful adjustments of electrical control circuitry are needed and individual adjustments are usually required at each installation.

SUMMARY OF THE INVENTION

Accordingly, the objects of this invention include provision of:

Humidifying apparatus which produces steam by electric heating, distributes a clean, sterile vapor to the atmosphere and overcomes the disadvantages discussed above in prior humidififers of the immersed electrode type.

Apparatus, as aforesaid, which is self contained and requires only three service connections, namely, one connection to an electrical supply, a water supply and a water drain, preferably a conventional single or three phase electrical outlet, a tap water connection and a connection to a sewer, respectively.

Apparatus, as aforesaid, which generates vapor by conduction of electric current through water between a pair of conductive electrodes, wherein the water supply is responsive to electrode current only so that a substantially constant steam generation capacity is obtained.

Apparatus, as aforesaid, wherein the water level in the evaporating receptacle is allowed to rise and fall as needed to maintain a substantially constant electrode current and wherein water level probes are not employed to control water level in the receptacle.

Apparatus, as aforesaid, wherein a substantially constant electrode current and therefore a substantially constant vapor generation rate can be set by a single manually adjustable control and wherein the vapor generation rate is automatically maintained without need for sensing or monitoring the water level and the electrical conductivity of the water, and wherein supply of water to control electrode current is accomplished by relatively simple circuitry controlling a simple electro-mechanical control element, such as a solenoid valve.

Apparatus, as aforesaid, which can provide steam to attain and maintain a desired humidity level in the local environment with the addition of relatively simple humidity sensing circuitry, wherein the apparatus can be preset for the desired humidity level by means of a single manual control.

Apparatus, as aforesaid, wherein variations in the conductivity of the water with water temperature, particularly during initial heating of cold water prior to boiling, can be compensated to prevent overshoot in the electrode current flow, and wherein such overshoot prevention circuitry can be employed to control a mechanical water removal element, such as a solenoid drain valve.

Apparatus, as aforesaid, capable of substantial moisture outputs per unit time sufficiently to satisfy a wide range of commercial, residential and light industrial humidification requirements, which provides self-modulation of the heating current supply and coordinates same with the water supply to provide a mechanically simple and highly reliable humidification apparatus.

Apparatus, as aforesaid, which is relatively compact, which is noncritical as to location, which is simple to operate, and wherein the water tank and electrodes are replaceable as a unit at relatively low cost in the event of excessive mineral buildup over a long period of use, and which is relatively inexpensive to manufacture and simple and inexpensive to maintain.

Other objects and purposes of this invention will be apparent to persons acquainted with apparatus of this general type upon reading the following specification and inspecting the accompanying drawings.

The objects and purposes of the invention are met by providing an electric resistance humidifier which increases atmospheric humidity by boiling water in a tank. Spaced conductive plates, or electrodes, are fixed in the tank. As the tank water level rises, the immersed area of the electrodes increases. An electric supply causes the electrodes to pass electric current through the tank water therebetween for heating and vaporizing such water. Electric current and heating cease automatically when the tank water level falls below the electrodes. A control includes comparator circuitry responsive to a reference signal and a signal related to electrode current flow for actuating and deactuating a water supply to the tank so as to maintain the electrode current substantially constant, regardless of variations in the conductivity of the water. In one embodiment, the control includes further comparator circuitry responsive to electrode current and a further reference signal for controlling a tank drain, to compensate for rising conductivity of the tank water as it is warmed and thereby prevent substantial change in the electrode current flow. In one embodiment, humidity sensing circuitry varies the reference signal level, to increase the electrode current amperage and thereby steam generating rate, in response to a decrease in atmospheric humidity, thereby to increase the atmospheric humidity to a desired level. The aforementioned apparatus is housed in a cabinet. A manual adjustor for selecting a fixed reference or humidity level is conveniently located on a panel of the cabinet.

DETAILED DESCRIPTION

Figure 2:
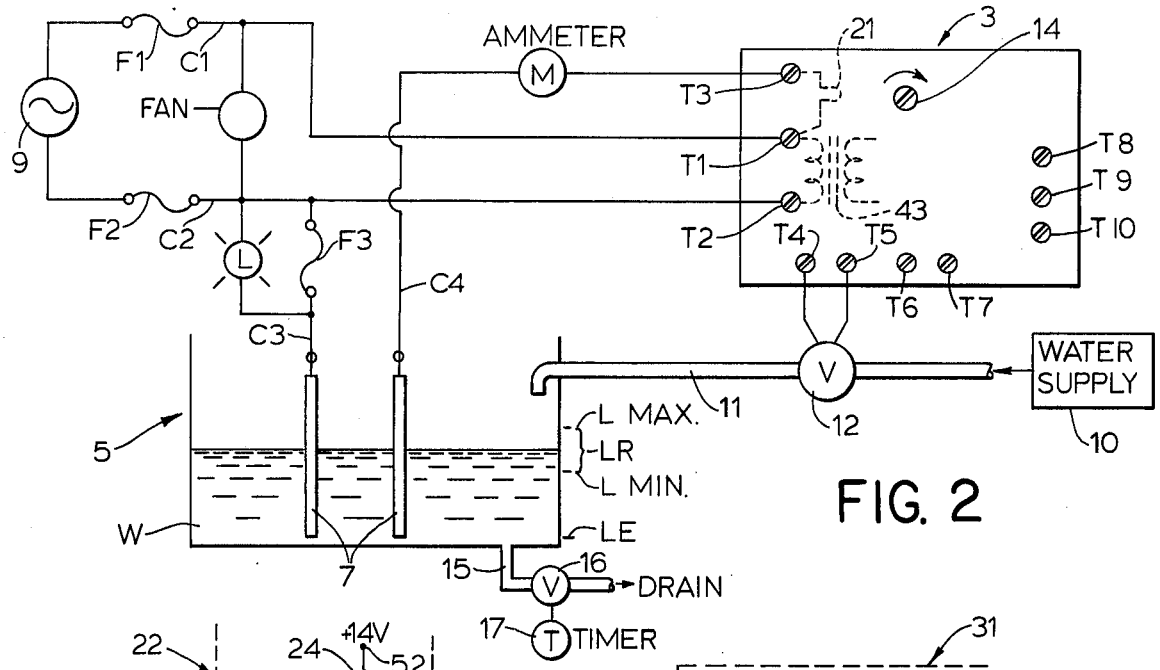
FIG. 2 is a diagrammatic presentation of the electrode and water supply connections to the apparatus of FIG. 1.
Figure 3:
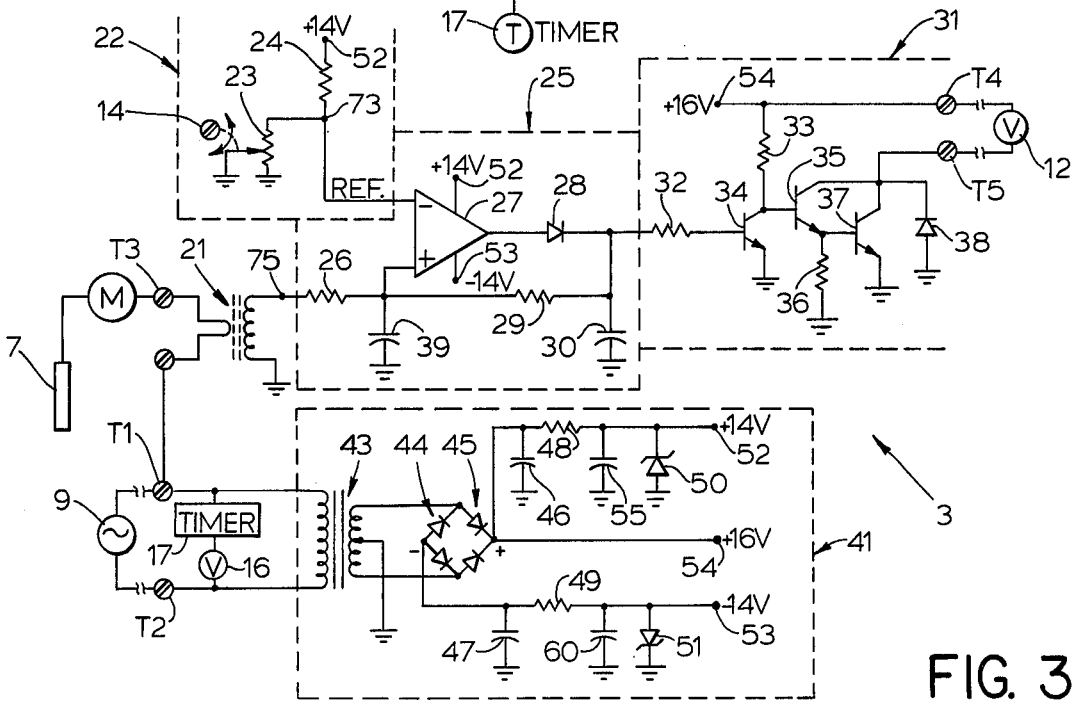
FIG. 3 is a circuit diagram of basic control circuitry of FIG. 2 with a manually selectable reference signal level.

FIGS. 2 and 3 diagrammatically disclose a basic form of the humidifier apparatus embodying the invention and which will maintain the electrode current and therefore the amount of steam that is generated therein at substantially preselected levels.

The tank 5 comprises a receptacle for water W to be vaporized. The tank 5 is open, preferably at the top thereof, for releasing water vapor, in the form of steam. A pair of electrodes 7, preferably formed as conductive plates, extend downwardly into the tank 5 in spaced side-by-side relation and are preferably spaced somewhat above the bottom wall of the tank 5. The tank 5 is preferably made of an insulating material such as a synthetic resin, such as polypropylene molding resin.

Operation of the apparatus is controlled by an electronic control unit 3. The electrodes 7 and control unit 3 receive electric power from a suitable fixed voltage source 9, conveniently a standard AC power circuit to which connection may be made by any convenient means not shown, for example a conventional AC plug and/or switch.

More particularly, a pair of conductors C1 and C2 connect to opposite sides of the electric power source 9, are provided with fuses F1 and F2, and are connected to terminals T1 and T2 of the electronic control unit 3. If desired, a fan can be connected across the supply conductor C1 and C2 for dissipating, to the local atmosphere, water vapor produced in cell 5. The fan F is optional and can be omitted if desired. One of the conductive electrodes 7 connects to the fixed voltage source line C2 through a conductor C3 and a paralleled fuse F3 and indicator lamp L. The other conductive electrode 7 connects through a line C4 to a terminal T3 of the electronic control unit 3. The fuse F3 prevents excessive current flow through the electrodes should the latter be shorted. The lamp L lights when the fuse F3 opens to indicate that a fault condition has occurred. Line C4 preferably includes an ammeter M.

A water supply conduit 11 connects the tank 5 to a conventional water supply 10, for example a tap connected to a city water supply, or the like, and flow through the conduit 11 is controlled by an electrically operated valve 12, conveniently a solenoid valve. The valve 12 is electrically controlled by a connection to output terminals T4 and T5 of the control unit 3. A drain conduit 15 is connected to the bottom of the tank 5 and it has an electrically controlled valve 16, conveniently a solenoid valve, whose operation is controlled by an adjustable timer 17. The timer will be set to open valve 16 at timed intervals, independent of the electrode current, to discharge some of the water in the tank when the mineral concentration therein builds up, whereby to maintain the mineral concentration of the water in the tank below a selected level.

FIG. 3 diagrammatically discloses primary circuitry of the control unit 3. The electronic control unit 3 comprises a current sensing transformer 21, a variable voltage reference source 22, a decision making comparator circuit 25, a valve drive circuit 31 and a DC power supply 41.

The primary winding of current transformer 21 connects through terminals T1 and T3, in series loop with one of the cell electrodes 7 and one side of the AC voltage source 9. The secondary winding of the current transformer 21 connects at point 75 to the input of comparator circuit 25 and to circuit ground.

The particular voltage reference circuit 22, shown in FIG. 3, provides a substantially constant, preselected vapor output regardless of the water level and the conductivity of the water in the tank 5. Reference circuit 22 thus comprises a series resistance 24 and potentiometer 23 coupled between the regulated positive supply line 52 of power supply 41 and ground, and provides a preset constant reference signal at intermediate point 73. The slider of variable resistor 23 is manually adjustable by a suitable knob 14 or the like accessible from inside of the apparatus cover hereafter discussed.

The comparator circuit 25 comprises an operational amplifier 27 connected as a level comparator. The reference signal line 73 connects to the inverting (−) input of the comparator 27 and the current transformer secondary output line 75 connects through resistor 26 to the noninverting (+) input of such comparator. The comparator output is coupled through a diode 28 to the valve circuit 31. The diode 28 and a capacitor 30 coupled therefrom to ground act as a detector for converting the alternating current signal from the comparator 27 to a DC voltage, for application to the valve circuit 31. A regenerative feedback network, including a resistor 29, couples the output of diode 28 to the noninverting input of the comparator 27, which input also connects through a capacitor 39 to ground.

The valve drive circuit 31 comprises an inverting amplifier transistor 34 having a collector and emitter respectively connected through a resistor 33 to a nonregulated positive power supply line 54 of power supply 41, and to ground. The base of transistor 34 connects through a limiting resistor 32 to the output side of diode 28. Output is taken from the collector of transistor 34 and applied directly to a Darlington connected power switch comprising transistors 35 and 37 and pull-down resistor 36. A protective diode 38 between the collector of Darlington transistor 37 and ground prevents reverse voltage spikes caused by operating the inductive solenoid load of valve 12 from damaging the Darlington transistors 35 and 37. The nonregulated positive potential line 54 of the power supply 41 connects through terminal T4, the solenoid of water fill valve 12 and terminal T5 to the collector of Darlington transistor 37, the emitter of which connects to the ground side of the power supply. Thus, conduction of transistor 37 flows current from the power supply 41 through the solenoid of valve 12, energizing the latter.

The power supply 41 comprises a step-down transformer 43 having a primary winding connected through terminals T1 and T2 to the fixed AC voltage supply 9. The secondary winding of step-down transformer 43 is center tapped to ground and drives a full wave bridge rectifier comprising diode pairs 44 and 45. The positive output of rectifier unit 44, 45 is applied directly to unregulated positive supply line 54 and is also applied to regulated positive supply line 52 through a filter comprising a series current limiting resistor 48 and a grounded parallel filter capacitor 46. The negative rectifier unit output is applied to negative potential line 53 through a filter comprising a series current limiting resistor 49 and parallel grounded filter capacitor 47. Voltage stabilizing Zener diodes 50 and 51, paralleled by bypass capacitors 55 and 60, respectively, connect between respective positive and negative potential lines 52 and 53 and ground. Thus, potential lines 52 and 53 provide stabilized positive and negative DC voltages, respectively.

Considering the operation of the apparatus of FIGS. 2 and 3, same provides a substantially constant vapor generation rate which rate is selectable by setting of the manual adjustor 14.

With the tank 5 empty, no tank water conductively couples electrodes 7. The electrodes 7 then act as an open switch in the AC loop comprising the electrodes, lines C3 and C2, AC voltage source 9, line C1, the primary of current transformer 21 (FIG. 3) and line C4 (FIG. 2). Thus, no current flows in such heating loop and no heating takes place. The same effect exists with a water level LE in the tank below the bottom of either electrode 7.

With a higher water level in the tank, sufficient to wet and form a conductive path between the plates 7, AC current flows in the AC heating loop comprising lines C3, C2, AC source 9, line C1, the primary of current sensing transformer 21 and line C4, thus through plates 7 and the intervening water in contact therewith. Such water acts as a resistance heating element and is heated by such current flow therethrough. At increasing water levels, increasing areas of conductive plates 7 are wetted and an increasing cross section of tank water flows electric current between the conductive plates 7. Consequently, the AC current flow through current sensing transformer 21, the heating of the water in tank 5, and the rate of vapor (steam) generation all increase as the water level in tank 5 rises above level LE.

The control unit 3 responds to the AC heating current level sensed by current transformer 21 and to the set position of manual adjustor 14, to actuate and deactuate water supply valve 12 so as to maintain electrode current, heating, and the rate of vapor generation each substantially at the desired level. Assuming for purposes of illustration an idealized condition in which the electrical conductivity of the water is constant, the water level would fluctuate within a relatively narrow range LR (shown enlarged in FIG. 2 with upper and lower ends marked LMAX and LMIN, respectively) and a virtually constant vapor generation rate would be achieved. However, in actual practice, because the electrical conductivity of the water is not constant owing to the variability of the mineral content thereof, the LR range shifts up or down relative to the tank depending on the electrical conductivity of the water. It is to be noted that the invention does not contemplate sensing water level directly, but rather senses electrode current. Thus the electrode current is maintained constant regardless of the water level in the tank. In this way variations in the water conductivity are automatically compensated for by shifting LR up or down so as to maintain substantially constant electrode current. When the water conductivity is high owing to a high mineral content, then LR shifts down, when water conductivity is low owing to low mineral content, then LR shifts up.

Thus, water is initially allowed to flow into the tank 5 through the solenoid valve 12, thereby starting and increasing the AC heating current through the tank 5. When a predetermined heating current level is reached and sensed by the control unit 3, the latter closes the valve 12 and water supply to the tank is stopped (as for example at LMAX in FIG. 2). As water heated by AC current flowing therethrough, vaporizes and leaves the cell 5, the tank water level gradually decreases. The resultant decrease in current flow, to a specified portion of the current level preset by adjustor 14, causes the control unit 3 to open valve 12 (as at LMIN in FIG. 2) and again permit water to enter the tank 5 until the former predetermined current level is reached and the valve 12 again closes.

A safety feature is that heating current will automatically shut off upon failure of the water supply system 10–12 to add fresh water to the tank 5, given sufficient vaporization of tank water to drop the tank water level to below at least one of the conductive plates 7.

Considering the internal operation of the control unit 3, the respective inputs of the comparator 27 (FIG. 3) receive the stable DC reference signal on line 73 at a level set by the adjustor 14, and the AC voltage, representing the cell heating current, through the resistor 26 from the secondary of current sensing transformer 21. When the peak positive value of the voltage on the secondary of sensing transformer 21 exceeds the level of the reference voltage at 73, the comparator 27 amplifies the difference and causes a greatly amplified difference signal to appear at the anode of diode 28. The diode 28 and capacitor 30 act as a detector, converting the alternating current signal from the comparator 27 to DC voltage, which is applied through limiting resistor 32 to the inverting input transistor 34 of the valve driving circuit 31.

The resistors 26, 29 control regenerative feedback to toggle the comparator 27 into a firm "on" state once the output of the current transformer 21 has exceeded the reference voltage on line 73. A controlled hysteresis is provided between the "on" state of the comparator and the point at which the comparator will toggle back to its "off" state. The amount of hysteresis is fixed by the values of resistors 26 and 29 and the DC resistance of the secondary winding of current sensing transformer 21. The filter capacitor 30 of the detector 28, 30 provides a sustaining time delay. More particularly, capacitor 30 is charged very rapidly by the low impedance output of the comparator amplifier 27 through diode 28, but its rate of discharge is caused to be less rapid by the relatively high discharge resistance presented by the diode 28, the limiting resistor 32 and the large value of feedback resistor 29. This sustaining time delay prevents nuisance toggling of the comparator 27 by brief current dropouts, caused by bubbling or sloshing of water in the tank 5. Capacitor 39 provides a short delay in toggling the comparator 27 to the "on" state, thereby preventing nuisance toggling due to noise spikes on the AC power line.

With insufficient water in the boiler tank 5 to permit maintaining the preselected electrode current magnitude and corresponding desired steam generation rate, the output of current sensing transformer 21 will be lower than the value of the reference voltage from reference circuit 22. Thus, the inverting (−) input of the comparator 27 will be more positive than the noninverting (+) input and the comparator output will be "low", or a negative DC voltage. The detector diode 28 thus will not conduct and no current will flow to the base of transistor 34. Transistor 34 is thus in the "off", or nonconducting, state. This allows current to flow through resistor 33 into the Darlington power switch 35, 37 at the base of its transistor 35, rendering the power switch transistors 35, 37 conductive. Thus current flows from the unstabilized positive supply line 54 through the solenoid of water supply valve 12 and conductive Darlington switch transistor 37 to ground, actuating the solenoid valve 12 and causing same to admit water from supply 10 to the tank 5.

When the water in the cell 5 has risen sufficiently, the heating current causes the output signal of sensing transformer 21 to exceed the reference voltage on line 73, the peaks of the positive half cycles of the output signal of sensing transformer 21 will be amplified by the comparator amplifier 27 and appear on the anode of the diode 28 as a positive signal, well above zero volts. Such signal causes the diode 28 to conduct, charging the capacitor 30. The comparator 27 will then toggle "on" (become fully conductive) because a portion of the voltage across the capacitor 30 is applied through resistor 29 to the noninverting (+) input of the comparator amplifier 27. Once the comparator amplifier is thus toggled "on", the voltage at the anode of diode 28 will be nearly the full positive supply voltage on supply line 52, providing sufficient current through resistor 32 to cause the transistor 34 to conduct. The conductive transistor 34 clamps the base of Darlington switch input transistor 35 substantially to ground, turning off Darlington switch transistors 35 and 37, closing the solenoid valve 12 and preventing more water from entering the tank 5.

As the water level drops (as through range LR), the comparator amplifier 27 remains toggled in its "on" condition due to the regenerative DC feedback from output to input through resistor 29, despite gradual lowering of the magnitude of the AC current peaks at the secondary of sensing transformer 21 with the decreasing water level. Ultimately however, the water level and sensing transformer signal drop sufficiently that the regenerative feedback path can no longer maintain the comparator 27 "on". At that point, comparator amplifier 27 again toggles "off", and as above indicated the valve 12 again opens to admit more water to the boiler tank 5. The above cycle repeats to maintain the preset vaporization rate, and until such time as the AC source 9 or water supply 10 is disconnected from the apparatus.

The present system can steam at a preselected substantially constant rate despite considerable change (e.g. build up) in the mineral concentration in the water in the tank 5. However, to slow the growth of mineral deposits on the electrodes 7 and surfaces of the tank 5 and maintain mineral concentration in the tank water below a limit, the continuously operating timer 17 periodically opens and closes the drain valve 16 in accord with a preset time cycle and independent of electrode current. The open and closed intervals may be set as desired but the drain valve 16 may be opened for example every two hours and held open for a time sufficient to drain the tank 5, thereby carrying away flaked-off mineral deposits and tank water having a high suspended solids content. An open time of four minutes is typical.

MODIFICATION

Figure 4:
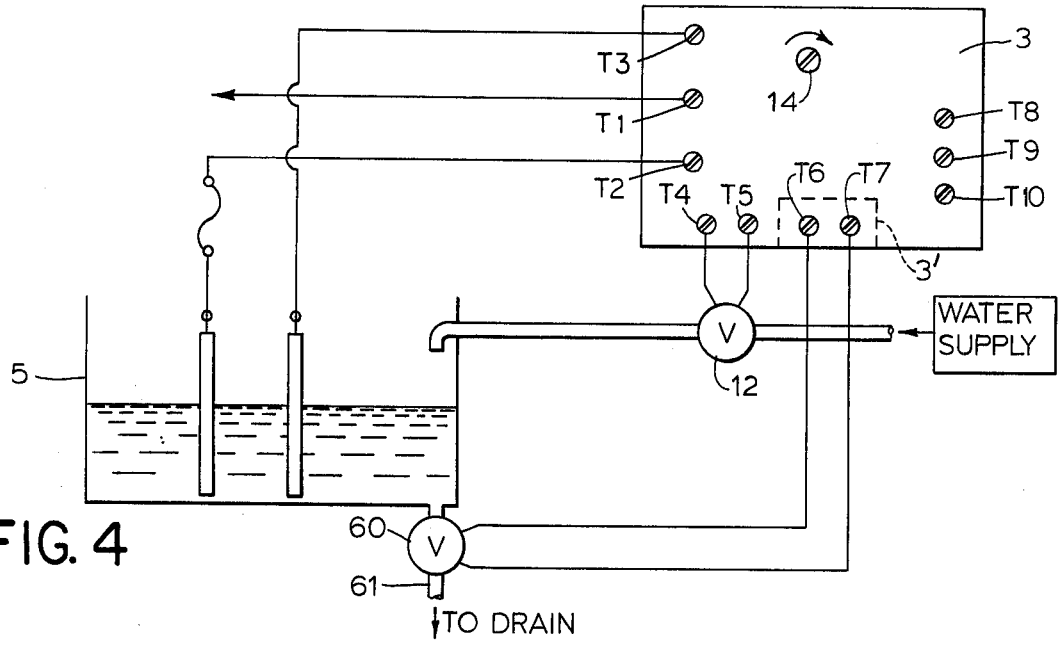
FIG. 4 is a diagrammatic view of a tank drain unit usable with the apparatus of FIGS. 1 and 2.
Figure 5:
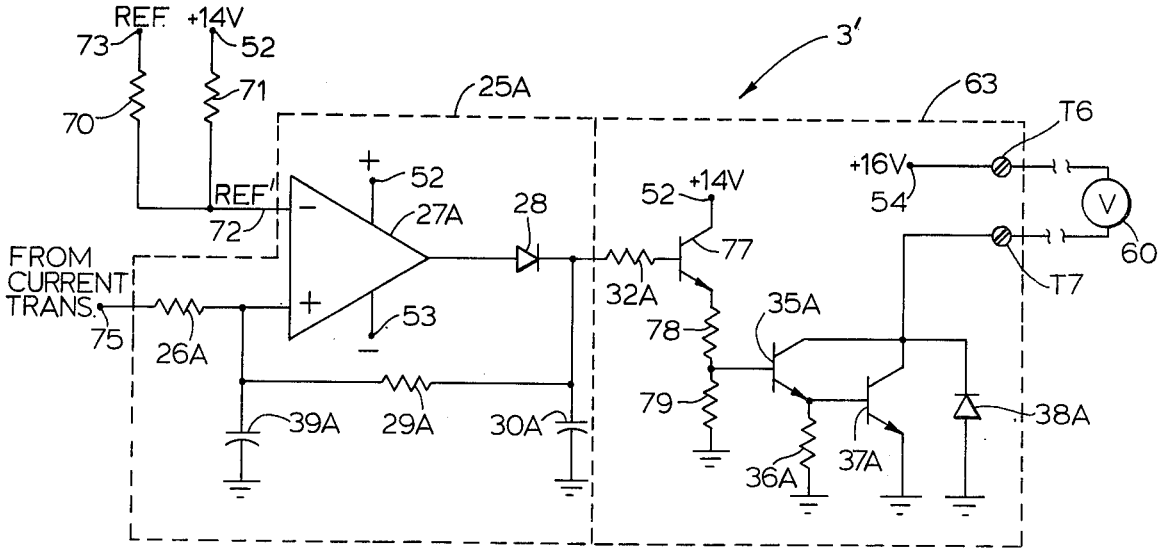
FIG. 5 is a circuit diagram showing control circuitry associated with the drain control of FIG. 4.

FIGS. 4 and 5 disclose an accessory usable where desired, with the above-described apparatus of FIGS. 2 and 3.

Such accessory apparatus is directed to a phenomenon which may occur during start up of the apparatus of FIGS. 2 and 3. More particularly, cold water admitted to the empty tank 5 rises along the plates 7. The conductivity of this incoming cold water is less than if the same water were at a higher temperature, e.g. at boil. In a given instance, water temperature may still be below boiling, hence with conductivity abnormally low, as water continues to enter the tank 5 and raises the water level therein to some level LMAX at which the fill valve 12 normally would shut off for the same water at boil. The tank then tends to continue to fill above normal level LMAX before electrode current reaches its preselected operating level, toggles the FIG. 3 comparator 27, and turns off the water supply valve 12. However, continued heating would increase water temperature and hence conductivity, and thereby cause an overshoot in heating current, in view of the abnormally high level of water in the tank. Whether this effect is significant in a given instance, depends for example on initial water temperature, the conductivity-temperature coefficient of the water and the tolerable overshoot in heating current. Heating current overshoot toleration may depend on the current ratings of the AC supply 9 and/or components including the several fuses F1-F3 and current transformer 21.

Again, it must be noted that the water level LMAX indicated in FIG. 2 is not a permanently fixed height on the tank wall, but rather will vary with changing conductivity of the water and is merely used as a convenient designation for any level to which the tank water has risen when electrode current grows large enough to shut off fill valve 12, under stable operating temperature (boil) conditions. The labels LMIN and LR are similarly variables and, with LMAX, will vary as water conductivity at boil changes, due to increase or reduction in mineral content.

Upon boiling, water temperature and level and heating current level stabilize at normal operating values, and the above phenomenon disappears.

The accessory arrangement of FIGS. 4 and 5 is directed to controlling such overshoot phenomenon during start up and may be employed where desired.

The accessory apparatus comprises a water removal means, preferably an electrically controlled drain valve 60 (FIG. 4), connected in a drain conduit 61 communicating with the cell 5. The electrical actuator (e.g. solenoid) of drain valve 60 is here shown as coupled through suitable conductors to terminals T6 and T7 in an accessory portion 3' of the control unit 3 for control thereby.

The accessory circuit portion 3' (FIG. 5) is an overshoot compensation circuit which includes a further decision making comparator circuit 25A, the output of which connects to a drain valve drive circuit 63. The circuits 25A and 63 are preferably identical to comparator circuit 25 and the supply valve drive circuit 31, respectively, of FIG. 3, except as hereafter noted. Similar parts in FIG. 5 carry the same reference numerals, with the suffix "A" added, as corresponding parts of FIG. 3 circuit, and require no further description.

The sensing (+) input of comparator 27A connects through resistor 26A to the secondary signal line 75 of the sensing current transformer 21 of FIG. 3. A reference circuit comprises series voltage divider resistors 70 and 71. Resistor 71 is connected to the stabilized positive supply line 52 of power supply 41 and divider resistor 70 connects to the reference signal line 73 of FIG. 3. The intermediate point 72 of the voltage divider 70, 71 connects to the reference (−) input of the comparator 27A.

The drain valve drive circuit 63 differs from the supply valve drive circuit 31 of FIG. 3 in having an input amplifying transistor 77 which is noninverting. The base of transistor 77 connects through current limiting resistor 32A to the output of comparator circuit 25A, its collector connects to the stabilized positive supply line 52, and its emitter connects through series dividing resistors 78 and 79 to ground. Output is taken from the emitter through resistor 78 and applied to the base of Darlington switch transistor 35A. Drain valve terminals T6 and T7 connect in series with the positive supply line 54 and Darlington switch transistor 37A.

When the tank 5 has filled with cold water sufficiently that the water supply valve 12 has closed, the heating current through the tank 5 tends to increase as water temperature rises and is additionally monitored by the accessory current sensing circuitry of FIG. 5. Such circuitry operates the drain valve 60 when the heating current overshoots its desired level by a given magnitude. Water is drained from the tank 5 until the current has dropped to a tolerable value, which is above the level at which the water supply valve 12 would reopen. Thereafter depending on the conductivity-temperature coefficient of the water, and its temperature, heating current is held near its desired level by subsequent openings of the drain valve 60, if necessary. When, eventually, reduction of water level due to vaporization, (as above discussed with respect to FIGS. 2 and 3) sufficiently reduces heating current, overcoming the current increase due to water temperature increase, the comparator 27 of control unit 3 again turns on the water supply valve 12 to again raise the water level, continuing the described FIG. 3 cycle of operation as the water heats. Thus, eventually the water in the tank 5 reaches its normal maximum operating temperature at boil, eliminating the initial current overshoot phenomenon, and heating current then stabilizes at the proper level. Thereafter, the FIG. 5 overshoot compensation circuit normally will remain deactuated with the drain valve 60 closed.

The internal operation of the overshoot compensation circuit 3' of FIG. 5 is essentially similar to the FIG. 3 circuit, with the following exceptions. The further reference voltage on line 72 is a somewhat higher potential than the reference voltage applied to comparator 27 of FIG. 3. Thus a somewhat higher heating current level (i.e. some overshoot) must be sensed at point 75 to toggle "on" the further comparator 27A. Thus, the drive circuit 63 will normally open the drain valve 60 in response to an overshoot in heating current following the cold water filling of the cell 5 and the shutting off of the water supply valve 12. By the same token, the comparator amplifier 27A will tend to toggle "off" and shut off drain valve 60 before comparator amplifier 27A toggles off to reopen water supply valve 12.

The drain valve 60 operates in a manner complementary to the supply valve 12, which is satisfied by the use of a non-inverting, rather than inverting, amplifier at 77. The desired offset of toggling points of comparator amplifiers 27A and 27 is satisfied by the connection of the voltage divider 70, 71 to common reference line 73.

Figure 8:
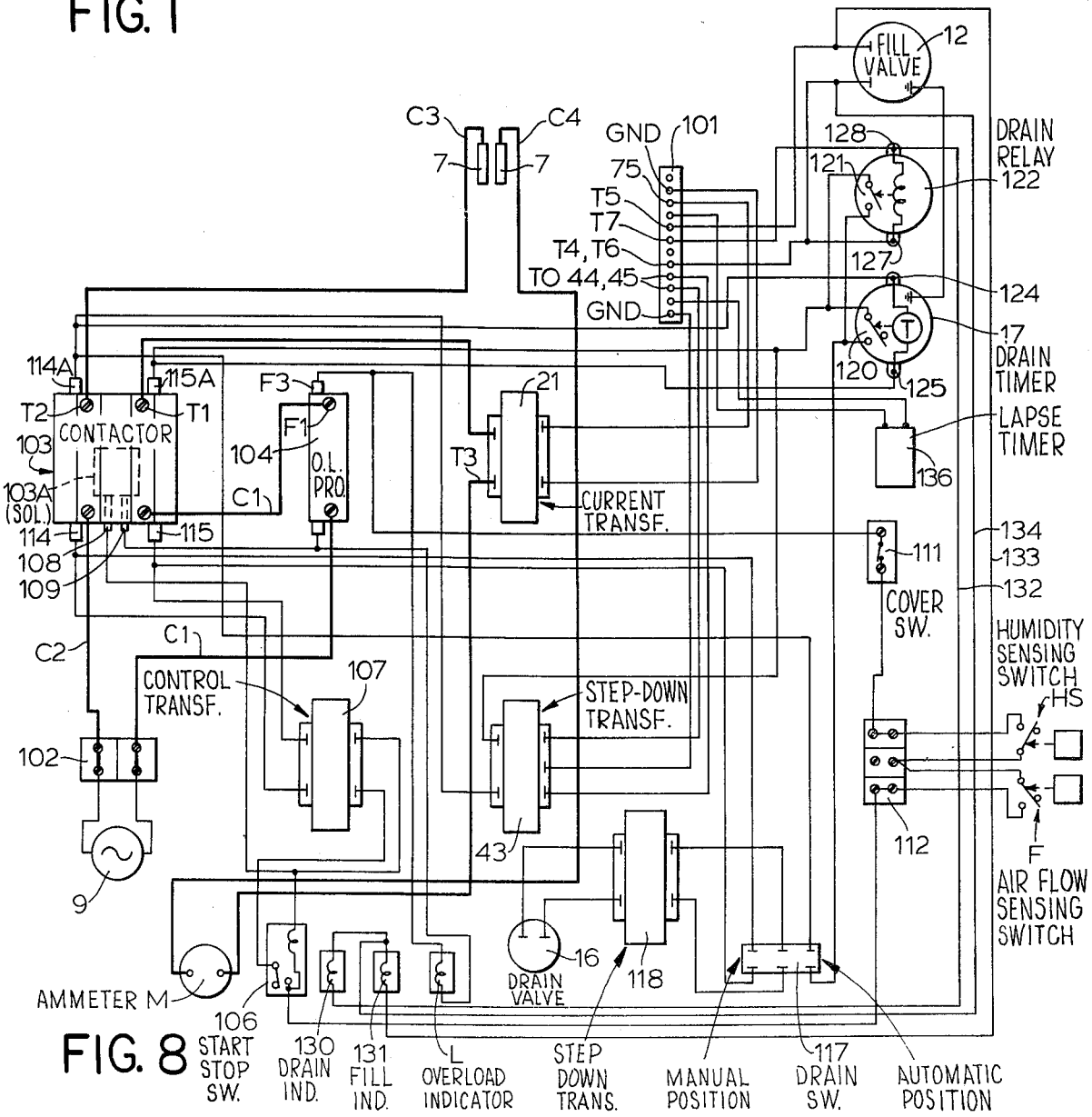
FIG. 8 is an interconnection diagram for the FIG. 7 apparatus.
Figure 7:
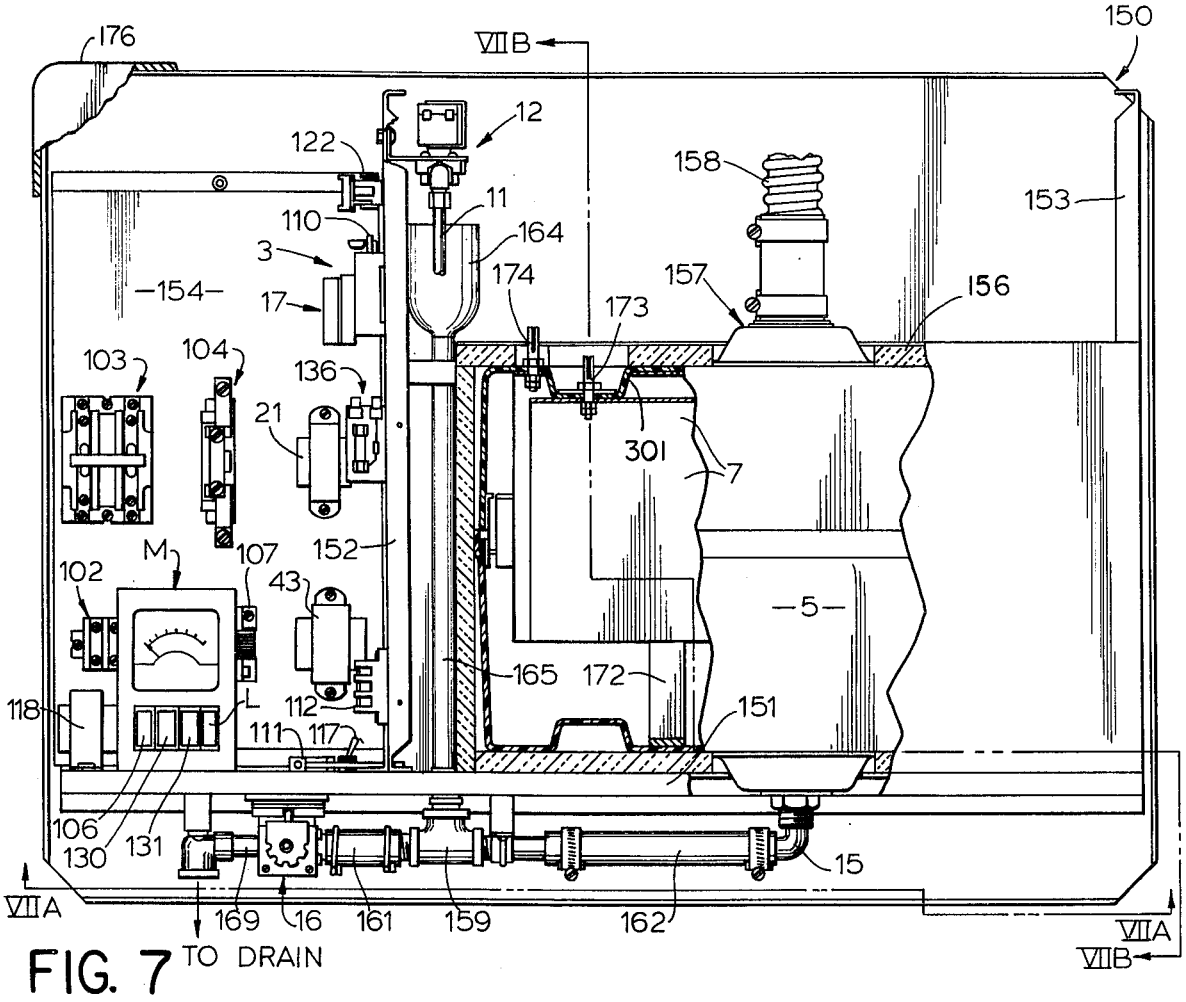
FIG. 7 is an enlarged partially broken front view of the FIG. 1 apparatus with the cover partially broken away.

While separately numbered and described above, the drain valves 16 and 60 may actually be implemented with a single valve as hereafter discussed with respect to valve 16 of FIGS. 7 and 8.

FURTHER MODIFICATION

In many instances, it is desired that a humidifier attain and maintain preselected humidity level in the local atmosphere, rather than merely continuously operate at a preselected constant vaporization rate (as above-discussed with respect to FIGS. 2 and 3). To adapt the control unit 3 of FIG. 3 from a constant vaporization rate mode to a constant humidity level mode, the humidity sensing circuit shown in FIG. 6 may be substituted for the fixed reference circuit 22 of FIG. 3, thus providing a humidity responsive reference signal via line 73' to the inverting (−), or reference, input of the comparator 27 of FIG. 3.

Figure 6:
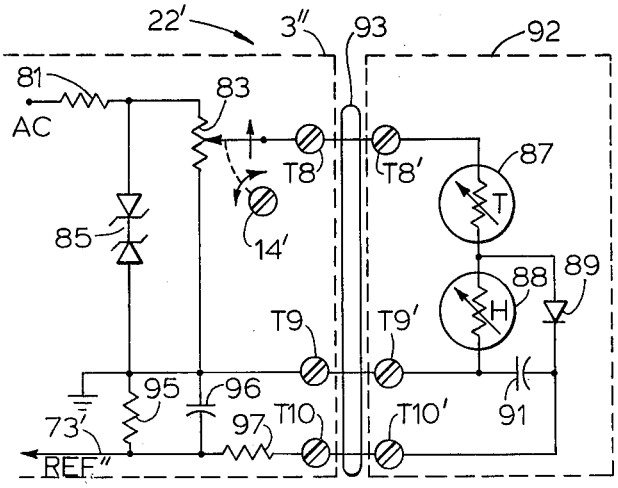
FIG. 6 is a circuit diagram of humidity sensing circuitry usable in the circuit of FIG. 3.

The humidity sensing circuit 22' of FIG. 6 comprises a stabilized AC reference source including back-to-back Zener diodes 85 connected in series with a current limiting resistor 81 across an AC reference source. The AC reference source may be conveniently the center tap and one end of the secondary of transformer 43 of FIG. 3. A potentiometer 83, or a tapped resistance network (not shown) connects from circuit ground across the back-to-back Zener diodes 85. Its slider, or tap selector, is adjustor by a manual adjuster 14' to set the desired humidity level. A humidity sensor 88, here having a resistance which decreases with increases in humidity, is connected to the ground line and, preferably by a series temperature compensating thermistor 87, to the slider of the humidity control potentiometer 83. A detector diode 89 and capacitor 91 connect in series across the humidity sensor 88 and the sensor output is taken from the cathode of diode 89 through a filter network comprising a series resistor 97 followed by a resistor 95 and parallel capacitor 96 connected to circuit ground.

The output of such filter is applied through reference signal line 73' to the reference input (−) of comparator amplifier 27 of FIG. 3, in place of the fixed reference on line 73 of FIG. 3.

The humidity sensor 88, and components 87, 89 and 91 directly connected thereto, may be housed with the remainder of the control unit 3. Alternately, the humidity sensing components 87-89 and 91 may be conventionally housed, as diagrammatically indicated in broken lines at 92, and remotely connected to the humidity control potentiometer 83, ground line and filter 95-97 through an intervening three conductor cable schematically indicated at 93, the corresponding conductors of which extend between terminals T8, T9, and T10 on the humidity reference portion 3' of the control unit 3 and terminals T8', T9' and T10' on the remote humidity sensor housing 92.

Instead of being located in the humidity reference portion 3" of control unit 3, the humidity control potentiometer 83 and its manual adjustor 14' may instead, if desired for convenience, be remotely located at remote housing 92. In that instance, resistor 81 and the upper one of Zener diodes 85 connect directly to terminal T8, the resistive element of potentiometer 83 is coupled across remote terminals T8' and T9' and the connection of terminal T8' to the upper side of thermistor 87 is through the slider of potentiometer 83.

The thermistor 87 and humidity sensor 88 function as a voltage divider across the AC reference source voltage supply through the slider of potentiometer 83. The potentiometer 83 serves as an adjustable humidity control. As the humidity seen by sensor 88 increases, its resistance decreases, decreasing the voltage at the anode of diode 89. The thermistor 87 has a temperature characteristic that matches that of the humidity sensor 88 and compensates same for variations in temperature. The detector diode 89 and capacitor 91 convert the AC voltage at the junction of thermistor 87 and humidity sensor 88 into a DC voltage. This DC signal, the amplitude of which represents the humidity status, is fed through the filter and voltage divider network 95, 96, 97, which removes any unwanted AC components from the signal and reduces the signal to a level compatible with the output of the current transformer 21 of FIG. 3.

The humidity reference signal on line 73' (FIG. 6) will thus increase with an increase in the desired humidity level (as reflected by setting of potentiometer 83 to increase the AC level applied across series thermistor 87 and humidity sensor 88) and with a decrease in humidity in the local environment (as reflected an increase in the resistance of humidity sensor 88). Thus, an increase in humidity reference signal level on line 73' is a call for an increase in the rate of vapor output by the apparatus of FIGS. 2 and 3. The apparatus of FIGS. 2 and 3 responds to an increase in the reference signal level, applied to the inverting (−) input of comparator 27, by increasing the level to which electrode current must rise to cause comparator 27 to toggle "on" and thus shut off the water supply at valve 12. The result is net upward shift of the operating water level range LR, an increase in electrode wetted surface, an increase in heating current conducted through the tank water, and a consequent increase in vaporization rate, as called for by the humidity sensing apparatus of FIG. 6.

Vaporization of water in the tank 5 will gradually increase the environmental humidity level toward the desired level set by humidity control potentiometer 83 of FIG. 6. During this time, the control unit 3 may cycle several times in the manner above-described with respect to FIGS. 2 and 3. Also as environmental humidity level rises, the humidity reference signal on line 73' (FIG. 6) correspondingly decreases. Thus the required heating current diminishes. Meanwhile control unit 3 may cycle, periodically opening fill valve 12 to the tank to make up for vaporization losses, filling to successively reduced levels as environmental humidity increases toward the desired level. This operation continues until the humidity in the environment reaches the desired, or set, level. This (or a manual reduction in the setting of humidity set potentiometer 83 to below the existing humidity level in the controlled area) stops cycling of the comparator 27 with the water supply valve 12 closed and the water level in the tank 5 below plates 7, and hence stops heating current flow and establishes an off condition.

When the humidity again falls to a point at which an operative humidity reference signal level appears on line 73' (or when a manual increase in the setting of the humidity set potentiometer 83 above the existing humidity level achieves the same result), the control unit 3 again, and in the manner above described, opens fill valve 12 (FIG. 3), raising the water level in the tank, and permitting electric current again to flow between the electrodes 7 to generate vapor and hence raise the humidity in the monitored environment. If a further decline in the humidity in the local environment, or room, occurs (or if the setting of humidity potentiometer 83 is further manually increased), the FIG. 6 circuit will continue to increase the signal on reference lines 73', increasing the vapor generation capacity until the humidity requirements for the controlled environment are satisfied, or until the maximum capacity of the apparatus has been reached.

In FIG. 6, an AC voltage reference is used in order not to chemically polarize the particular humidity sensor used. Also, high signal and reference voltage levels are preferably employed, to increase the signal to noise ratio, when, as shown in FIG. 6, portions of the humidity sensing circuitry are located remotely from the control unit 3.

To incorporate the circuits of FIGS. 3, 5 and 6 in a common control, the FIG. 6 reference output line 73' is connected both to the reference (−) input of comparator 27 of FIG. 3 and to the reference input line 73 of FIG. 5.

FIG. 8 is an interconnection diagram for an embodiment of the invention and shows the way in which portions of the electrical circuitry above-discussed with respect to FIGS. 2-5 may interconnect with each other to provide the desired apparatus operation. For convenience, the electronic circuitry portion of the FIGS. 3-5 circuits may be accommodated on one or more printed circuit boards and such in FIG. 8 is represented merely by a printed circuit board block 101. In FIG. 8, then, connection to the conventional AC electrical source 9 is made through a conventional terminal block 102 which connects, as through leads C1 and C2 to a main line contactor, of conventional type generally indicated at 103 and which provides a convenient source of AC power to remaining AC-fed components as indicated in FIG. 8. Interposed in line C1 is an overload protector 104 which may be identified with fuse F1 (and for that matter here includes a further portion corresponding to fuse F3) of FIG. 2, fuse F2 of FIG. 2 here being omitted. During apparatus operation, the contactor 103 supplies AC operating potential to various components as above-described, including the circuit loop incorporating electrodes 7, 7, ammeter M and the primary of current transformer 21. The contactor also supplies AC operating potential to the transformer 43 whose secondary ends and center tap directly connect, as shown, to the printed circuit board block 101 at which is located the rest of the power supply 41 of FIG. 3, as well as the FIG. 3 circuitry driven by the secondary of current transformer 21. Also, the overload indicator light L is here coupled across the portion of overload protector 104 indicated at F3.

FIG. 8 introduces several additional features not discussed above with respect to FIGS. 2–6. A stop-start switch 106 of the conventional type having a built-in light to indicate the "on" condition of the switch, has its normally open, manually closable contacts connected in series loop with the secondary winding of a control transformer 107 (and with the indicating lamp built into the stop-start switch 106). Connected across said stop-start switch lamp is a series path including a pair of input terminals for the solenoid 103A of the contactor 103, the portion labeled F3 of the overload protector 104 (shunted by overload indicator light L), a cover switch 111 closed when the cover (hereafter discussed) of the apparatus is properly in place, and, if desired, a terminal block 112. In the embodiment shown, the terminal block 112 normally provides a straightthrough electrical connection between cover switch 111 and start-stop switch 106, to flow current through solenoid 103A when switch 106 is closed. The purpose of the block 112 is to prevent circuit operation and hence continued vapor generation under specified conditions. For example, where the apparatus supplies vapor to a remote location through an overhead duct, a conventional humidity sensor switch HS in the duct may be set to open at a preset maximum humidity level in the duct (e.g. 90%). Also, the duct may be provided with a fan (as in FIG. 2) to move vapor from the apparatus through the duct to such location, and a suitable fan motor responsive or air flow responsive switch F may be arranged to open should such fan fail. By connection of such a switch HS or F (or both in series) across the block 112, opening of either, in response to excessive duct humidity or duct fan failure, guards against vapor condensation in and water leakage from such duct, by blocking current flow to the terminals 108 and 109 of the solenoid 103A. When such protective measures are not needed, the block 112 and switches HS and F can be replaced by a wired connection between switches 106 and 111.

The humidity switch HS, or additional such switches in the series path across the terminal block 112 can be located in a room for limiting the humidity therein to the desired level by opening the line contactor 103 to interrupt the heating current. Thus, either an on-off humidity sensor switch, like switch HS, or the FIG. 6 variable output humidity sensing circuit, can be used to control humidity in such room.

In the preferred embodiment shown, the primary winding of control transformer 107 is AC energized from the AC supply terminals of the contactor 103 which terminals are in turn energized from AC power lines C1 and C2. The secondary of control transformer 107, upon closure of start-stop switch 106 (and with a closed path through elements 104, 111 and 113) thus energizes main contactor solenoid 103A, which applies AC potential from lines C1, C2 to terminals T1, T2 and 115A, 114A, such that portions of the apparatus connected to such terminals are controlled by the start-stop switch 106.

In the embodiment shown, the drain valve 16 is arranged to serve the functions above-described of both timer operated drain valve 16 of FIG. 3 and cold start drain valve 60 of FIG. 5. Accordingly, the FIG. 8 drain valve 16 is controlled from a double-pole-double throw drain switch 117, here for example through a voltage step-down transformer 118. In its manual position, manual-automatic drain switch 117 supplies AC potential from terminals 114 and 115 through transformer 118 to place drain valve 116 in its open condition for draining water from tank 5. On the other hand, when the rightward or automatic position of drain switch 117 is selected, it establishes a series connection from AC terminal 114A through the transformer 118 primary, and paralleled normally open contacts 120 and 121 of drain timer 17 and a drain relay 122, which in turn connect to the corresponding AC terminal 115A, permitting either the drain relay 122 or drain timer 17 to open the drain valve 16. The AC input terminals 124 and 125 of the timer 17 connect respectively to AC supply terminals 114A and 115A so that the drain timer 17 continuously times while the start-stop switch 106 is in its operating mode. The drain timer 17 may be of any convenient type capable of timing for a preselected interval, e.g. two operating hours, opening the drain to flush mineral laden water from the tank for a preselected short interval, e.g. four minutes, and repeats this cycle as long as the start switch 106 and contacts HS, F, and 111 remain "on", substantially operating in the manner above described with respect to FIG. 3.

In the FIG. 8 embodiment, it is the DC input terminals 127 and 128 of drain relay 122 which connect to the FIG. 5 terminals T6 and T7, rather than the drain valve solenoid directly, such that conduction of the FIG. 5 transistor 37A produces a DC current flow through the drain relay terminal 127 and 128, closing contact 121 thereof and therethrough closing the AC connection to the automatic side of drain switch 117 for actuation of the drain valve 16 in the manner above-described.

As shown in FIG. 8, the fill valve 12, as in FIG. 3, is connected across DC path terminals T4 and T5, though for convenience in FIG. 8, positive potential terminals T4 and T6 appear as a single terminal on the output side of the printed circuit terminal block 101.

In FIG. 8, a drain indicator light 130 and a fill indicator light 131 are respectively connected across the DC input terminals 127 and 128 of the drain relay and the DC input terminals of the fill valve 12, by lines 132 and 133, respectively, along with common line 134, such that actuation of the drain relay actuates the drain indicator light 130 and actuation of the fill valve 12 actuates the fill indicator light 131. It will be noted that the fill valve operates in the manner above-described with respect to FIG. 3. On the other hand, the drain valve 16 operates in the manner above-described with respect to FIGS. 3 and 5, though in the FIG. 5 mode through drain relay 122, and in both modes through the automatic position of the drain switch 117 and, if desired, transformer 118, so as to provide both periodic draining and draining on a cold start to avoid excessive heating current (as well as to provide manually controlled draining when the manual, leftward position of switch 117 is selected).

If desired, a lapse timer 136 may be provided to monitor the total number of apparatus operating hours and may be used in conjunction with any convenient indicating or alarm means to inform the system operator that routine maintenance (e.g., replacement of the steam generator tank 5 or electrodes 7 therein) should be considered.

In some instances it may be desired to admit some fresh cool water from the fill valve 12 when the drain valve 16 is periodically opened by drain timer 17, so as to dilute and reduce the temperature of water draining from the tank 5. Such is here accomplished in a convenient manner, since as water is drained from the tank, by the opened drain valve 16, the water level and heating current fall. A sufficient drop in heating current flow through transformer 21 causes the FIG. 3 circuit to open the fill valve 12, as above described, thus automatically mixing cool fresh water with the hot draining tank water, at tee 159, on the way to drain.

Figure 1:
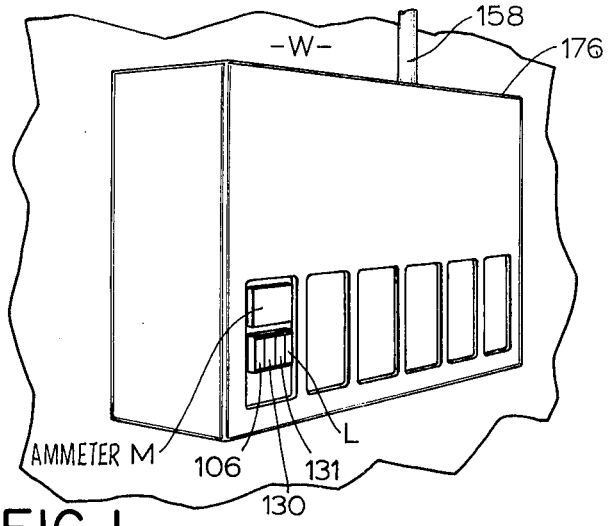
FIG. 1 is a pictorial view of an apparatus embodying the invention.
Figure 7A:
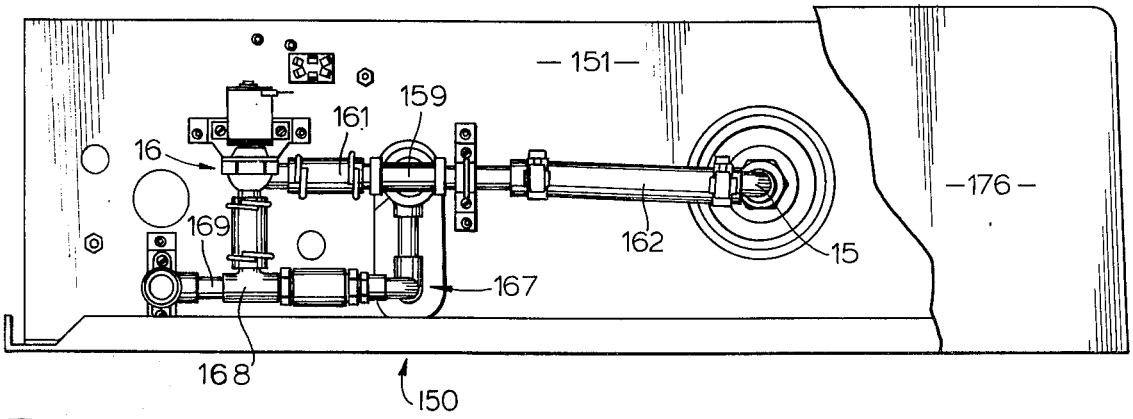
FIG. 7A is a sectional view substantially taken on the line VIIA—VIIA of FIG. 7
Figure 7B:
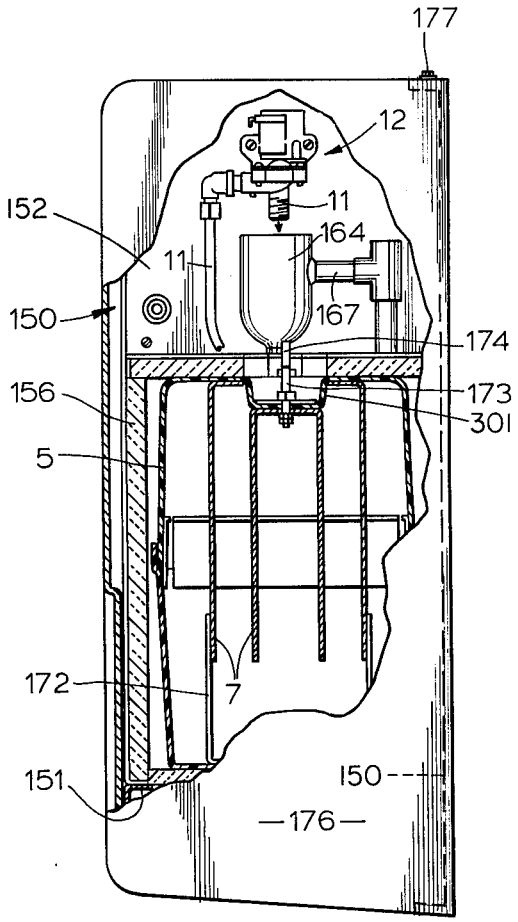
FIG. 7B is a cross sectional view substantially taken along the line VIIB—VIIB of FIG. 7.

FIG. 1, and in more detail FIGS. 7–7B, show mechanical aspects of a preferred embodiment of the invention. The apparatus includes a chassis 150 (FIGS. 7 and 7B) preferably wall mountable, including a shelf 151, upstanding bulkheads 152 and 153 between which the tank 5 is disposed, and a component plate 154, the major electrical components being carried by bulkhead 152 and adjacent plate 154, as shown in FIG. 7.

The tank 5 is preferably a sealed, disposable unit which may be covered with insulation as indicated at 156 and has an upward opening vapor outlet 157, here coupled to a flexible vapor distribution conduit 158 which may lead to suitable duct work and a distribution fan or the like not shown.

The drain conduit 15 communicating through the bottom of the tank 5 and extending to the drain valve 16 (FIGS. 7 and 7A) incorporates a tee 159 flanked by suitable conduit means 161 and 162. The water fill valve 12 is fixed to bulkhead 152 above, and empties into, the open upper end of a funnel cup 164 (FIGS. 7 and 7B) having a downward extending water supply tube 165 connected to the tee 159. An overflow conduit 167 tapped into the funnel cup 164 below the top thereof extends downward, eventually connecting, along with the outlet side of the drain valve 16, at a tee 168 with further conduit means 169 to drain. The outlet from the water fill valve 12 terminates above the funnel cup 164 and accordingly the water supply to the fill valve 12 is isolated from the water in tank 5 even should same rise to the level of overflow 167 or even the top of funnel cup 164 (which the presence of overflow 167 would normally preclude). Opening of fill valve 12 causes water to flow into the tank 5 through the path 164, 165, 159 and 162. On the other hand, opening of drain valve 16 causes water to exit the tank 5 through the path 162, 159, 161, 16 and 169. If desired, such draining of water from the tank 5 may be accompanied by opening of the fill valve 12 so that cool fill water entering the tee 159 through the path 164, 165 mingles with and reduces the temperature of hot water exiting the tank through the path 162, the mixture of hot and cold water passing then through the path 161, 16, and 169 to drain.

In the preferred embodiment shown, the electrodes 7 extend substantially the length of the tank 5 and are each of inverted U-shaped cross section. One electrode is narrower than, and situated between the legs of, the other as generally indicated in FIG. 7B. In the embodiment shown, relatively narrow U-shaped strips 172 supported on the bottom wall of the tank contact and steady the depending legs of the outer electrode 7. The central webs of the channel-like electrode 7 are each provided with electric current terminals, shown at 173 and 174, respectively, to which the AC supply lines, as at C3, C4 in FIG. 2, may connect. The top surface of the outer electrode is provided with an aperture through which downwardly extends a boss 301 (FIG. 7B) in the top wall of tank 5, such boss supporting the inner electrode by means of the the electric current terminal 173, and insulating the inner electrode from the outer electrode.

FIG. 1 discloses the apparatus above-discussed with respect to FIGS. 7-7B mounted on a wall W with the vapor conduit 158 extending upward therefrom, and with a decorative cover 176 disposed thereover. The meter M and lamp end switch units 106, 130, 131 and L are disposed at an opening in the lower left corner of the cover for ready access and visibility.

The cover 176 may be supported on the chassis 150 by any convenient means such as screws 177 (FIG. 7B).

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A humidifying apparatus having a water tank open to an atmosphere to be supplied vapor, spaced electrodes in the tank of wetted surface increasing with the water level in the tank, means for conducting electric current through said electrodes and the intervening tank water to heat and vaporize the water, a water supply means openable to add water to the tank, a drain openable for draining water from said tank, said apparatus further comprising in combination:

heating current control means responsive to dropping of said current through said electrodes to below a level corresponding to a reference signal for adding water to said tank from said water supply means until said heating current again corresponds to said reference signal, and therewith maintaining heating current flow at substantially a level corresponding to said reference signal regardless of change in tank water conductivity in ongoing operation;

a drain timer independent of changes in heating current and tank water conductivity and responsive merely to ongoing apparatus operation for timing a continuous series of preset intervals and briefly opening said drain on a regular periodic basis at the end of each said interval, said drain timer means being free of control by said heating current control means;

heating current overshoot control means responsive to an excessive heating current above a level corresponding to an overshoot reference signal exceeding said first mentioned reference signal by a selected overshoot amount for opening said drain independent of said drain timer and closing said drain before heating current falls sufficiently to cause addition of water to said tank by said heating current control means;

a humidity reference signal source connected to said heating current control means and to said heating current overshoot control means for varying said reference and overshoot reference signals, and thus actuation of said water supply means and drain, in response to variations in humidity in said atmosphere.

2. The apparatus of claim 1, in which said drain includes an electrically operated drain valve actuable for draining water from said tank and a drain switch actuable to a manual position for manually opening said drain valve, and alternately actuable to an automatic position, said drain timer including a timer contact briefly closable thereby at the end of each said preset interval, said overshoot control means having an overshoot contact normally closable upon such an overshoot in heating current, said timer contact and overshoot contact being connected in parallel with each other, an electric supply loop including in series an electrical supply means, said parallel overshoot and timer contacts and in the automatic position of said drain switch, said drain valve, such that actuation of either one of said timer and overshoot contact will in the automatic position of said switch actuate said drain valve to open.

3. The apparatus of claim 1, including an elongate vapor conduit extending from the vapor outlet portion of said tank to a point of vapor use remote therefrom and means in addition to said humidity reference signal source for sensing an excessive moisture or condensation condition in said elongate conduit and including a power interlock switch openable in response to such a condition to shut down the apparatus.

4. The apparatus of claim 1, in which said water supply means includes a valve controlled water supply conduit with its outlet end located above and opening downward adjacent said water tank, and a funnel-shaped upwardly opening isolation cup spaced below said water supply conduit outlet for supplying water to said tank, said drain including a drain conduit connected by a drain valve to a drain outlet on said water tank, the apparatus further comprising a water inlet conduit connecting said funnel-shaped cup with said drain conduit between said drain valve and said tank drain outlet, such that a drop in tank water level from opening said drain valve causes said heating current control means to open said valve controlled water supply conduit to cool hot water draining from said water tank.

5. The apparatus of claim 4, including a wall mountable chassis having a shelf adjacent the lower end thereof and an upstanding bulkhead laterally dividing said chassis into a circuitry zone and a water handling zone, said water tank being a disposable tank supported on said shelf in said water handling zone with said valve controlled water supply conduit and funnel-shaped cup supported with respect to said bulkhead adjacent said tank, said tank being removable from said chassis by disconnection of said electrodes, drain conduit and any connection to the vapor outlet of said water tank, for ready replacement of said tank and electrodes as a unit.

6. A humidifying apparatus having a water tank open to an atmosphere to be supplied vapor, spaced electrodes in the tank and of wetted surface increasing with the water level in the tank, means for conducting conventional alternating electric current through the electrodes and intervening tank water to heat and vaporize the water, heating current control means for maintaining said heating current substantially at a reference value, regardless of change in tank water conductivity in ongoing operation, water supply means actuable for adding water to said tank to increase said heating current through said electrodes, and drain means openable for draining water from said tank and therewith limiting the buildup in concentration of minerals in said tank, in which said heating control means comprises:

reference means for supplying a DC reference signal, means providing an AC signal proportional to heating current flow through said electrodes, a level comparator having one input terminal connected to receive said DC reference signal and a second input terminal connected to receive said AC signal for producing an amplified AC difference signal when the peak value of said AC heating current proportional signal passes said DC reference signal, positive feedback means connected to an input of said level comparator for toggling same to a firm conductive state and holding same there until said peak of said AC heating current porportional signal falls substantially below said DC reference signal, an output circuit including electronic switch means, said water supply means comprising a source of water under pressure and a solenoid valve actuable by said electronic switch means for controlling water flow from said source to said tank, a detector means connected to the output of said level comparator for converting the AC output of the latter to a DC output signal and applying the latter to said positive feedback means and output circuit.

7. The apparatus of claim 6, in which said AC signal providing means consists of a current transformer in series with said electrodes with merely a linear voltage dropping means providing the AC signal connection from said current transformer to said second input terminal of said level comparator.

8. The apparatus of claim 6, including an input delay capacitor connecting said AC input terminal of said level comparator to ground, said detector means comprising a diode and further capacitor to ground with a positive feedback resistor having opposite ends connected to ground through said capacitors.

9. The apparatus of claim 6, in which said detector means comprises a diode and capacitor connected in series from the output of said level comparator to ground, and resistors connected from a point between said diode and capacitor, respectively, to said level comparator's AC signal input terminal as part of said positive feedback means and to said electronic switch means.

10. The apparatus of claim 9, in which said output circuit further includes an input transistor and a Darlington transistor pair driven thereby and in turn connected to actuate said water supply means.

11. Apparatus according to claim 6, including a current overshoot level comparator having a DC reference signal input connected to said reference means to receive further reference signal offset from said first mentioned DC reference signal, for toggling of said level comparators at respective different heating current levels, said overshoot level comparator having an AC input connected in parallel with the AC input of the first mentioned level comparator to also receive said AC heating current proportional signal, a further detector means connected to the output of said current overshoot level comparator for converting the AC output of the latter to a DC output signal, positive feedback means connecting said further detector means with an input of said overshoot level comparator and output circuit means connecting said further detector means to a drain valve for actuating same, said drain valve being a part of said drain means.

12. The apparatus of claim 11, in which said output circuits of said first and overshoot level comparators each comprise an input transistor connected to the corresponding said detector means and connected to drive a Darlington transistor pair in turn connected to corresponding fill and drain valves, said fill valve being part of said water supply means, one but not the other of said input transistors being connected in polarity inverting relation between its detector means and Darlington transistor pair.

13. A humidifying apparatus having a water tank open to an atmosphere to be supplied vapor, spaced electrodes in the tank of wetted surface increasing with the water level in the tank, means for conducting electric current through said electrodes and the intervening tank water to heat and vaporize the water, a water supply openable to add water to the tank, a drain openable for draining water from said tank, said apparatus further comprising:

heating current control means responsive to dropping of said heating current through said electrodes to below a level corresponding to a reference signal for adding water to said tank until said heating current rises again to said reference signal, and therewith maintaining heating current flow at substantially a level corresponding to said reference signal, regardless of change in tank water conductivity in ongoing operation;

a reference signal source including a humidity sensor for sensing ambient humidity in said atmosphere to be supplied vapor;

a desired humidity selector for selecting the desired ambient humidity in said atmosphere and humidity reference signal generating means connected to said heating current control means and responsive to the difference between said sensed and selected humidity for generating said reference signal.

14. The apparatus of claim 13, including heating current overshoot control means responsive to an excessive heating current corresponding to an overshoot signal exceeding said reference signal by a selected overshoot amount for opening said drain and closing said drain before heating current falls sufficiently to cause addition of water to said tank by said heating current control means, said humidity reference signal generating means being also connected to said overshoot control means, said heating current control means and overshoot control means each including a level comparator having a reference signal input connected with said humidity reference signal source and a heating current signal input responsive to current through said electrodes.

15. Apparatus according to claim 13, in which said heating current control means includes a comparator receiving said reference signal and a signal proportional to heating current and said humidity reference signal source comprises means responsive to changes in humidity for providing a said reference signal variable as a function of humidity and poled to reduce the heating current level limit at which said comparator turns on said water supply means in response to increased humidity sensed, whereby under conditions of increasing humidity, the tank will operate with a decreasing average water level and average water vapor output.

16. The apparatus of claim 13, in which said humidity sensor is connected across a stabilized AC voltage supply, said desired humidity selector being in circuit with said stabilized AC supply and humidity sensor for setting the desired level of humidity to be provided by said apparatus, said AC supply preventing polarization of said humidity sensor, a detecting diode coupled to said humidity sensor and filter means at the output thereof for providing a humidity responsive DC reference signal to the reference signal input of said heating current control means.

* * * * *